United States Patent [19]

DeGood

[11] Patent Number: 4,642,953

[45] Date of Patent: Feb. 17, 1987

[54] MOVEABLE STAIR APPARATUS

[76] Inventor: David A. DeGood, 3174 Hudson, Hudsonville, Mich. 49426

[21] Appl. No.: 827,818

[22] Filed: Feb. 10, 1986

[51] Int. Cl.[4] ..... E04F 11/04; E06C 9/10

[52] U.S. Cl. ..... 52/183; 52/185; 182/186

[58] Field of Search ..... 52/182, 183, 185; 182/86, 106, 83, 84, 85, 91, 101

[56] References Cited

U.S. PATENT DOCUMENTS

| | | | |
|---|---|---|---|
| 309,951 | 12/1884 | Hoffman | 182/85 |
| 479,436 | 7/1892 | Lummus | 182/86 |
| 517,335 | 3/1894 | Elieson | 182/86 |
| 867,092 | 9/1907 | Ashford | 182/86 |
| 1,166,141 | 12/1915 | Merrettig | 182/86 |
| 1,455,928 | 5/1923 | Morrill | 182/86 |
| 2,220,155 | 11/1940 | Jachim | 228/48 |
| 2,542,923 | 3/1951 | Hallen | 228/59 |
| 3,731,761 | 5/1973 | Glenn | 182/1 |
| 4,115,887 | 4/1978 | Ewards | 182/84 |

FOREIGN PATENT DOCUMENTS

| | | | |
|---|---|---|---|
| 3315817 | 11/1984 | Fed. Rep. of Germany | 52/182 |
| 2341716 | 9/1977 | France | 52/183 |

*Primary Examiner*—John E. Murtagh

*Attorney, Agent, or Firm*—Ian C. McLeod

[57] ABSTRACT

A moveable stair apparatus 10 is described for allowing access from a lower floor 103 to a loft or upper floor 101 in a building or between the upper floors 101 and 102 in the building. The moveable stair apparatus includes a plurality of equally spaced apart moveable steps 12 mounted on a girder assembly 11 with a plurality of vertically extending posts 15 mounted to the steps and also a pair of parallel hand rails 16 mounted to the posts. A first pivot pin 18 is secured to the girder assembly to allow pivotable movement of the moveable stair apparatus to a lower floor 103 in a stairway position or to a second floor 102 in a catwalk position.

10 Claims, 6 Drawing Figures

MOVEABLE STAIR APPARATUS

BACKGROUND OF THE INVENTION (1) Field of the Invention

The present invention relates to a moveable stair apparatus which provides a stairway from a lower floor to an upper floor of a building or a catwalk between upper floors of the building. In particular the present invention relates to a moveable stair apparatus which includes a plurality of pivotable steps mounted on a girder assembly with vertically posts mounted to the steps and with parallel hand rails pivotably mounted on the posts.

(2) Prior Art

The prior art has described a number of folding stairways or latters. IIllustrative are U.S. Pat. Nos. 2,220,155 to Jachim, 2,542,923 to Hallen and 3,731,761 to Glenn. In each of these stairways the steps are pivotably mounted on a frame. A separate hand rail is provided mounted on the frame which may or may not pivot with the stairs. These stairways can include a lift cable as shown in Hallen. The problem is that these stairways are too bulky and industrial looking for home use.

OBJECTS

It is therefore an object of the present invention to provide a moveable stair apparatus which allows access from a lower floor to a loft and a catwalk to a second floor of a building. It is further an object to provide a plurality of equally spaced apart pivotable steps and pivotable hand rails mounted on the steps wherein the steps are attached to a girder assembly so as to allow pivotable movement of the stair apparatus. These and other objects will become increasingly apparent by reference to the following description and the drawings.

GENERAL DESCRIPTION

The present invention relates to a moveable stair apparatus for use in a building which comprises: a pair of spaced apart girder assemblies having a top and bottom and parallel opposed sides; a plurality of equally spaced apart horizontally oriented steps which are pivotably positioned on a horizontal longitudinal axis between said opposed sides of said girder assembly; a plurality of rods mounted in a horizontal plane along the axis beneath said steps and journaled between the said opposed sides of said girder assembly and rigidly mounted to said steps so that said steps are pivotable; a pair of spaced apart parallel hand rails mounted above said girder assembly and steps including a plurality of vertically extending posts rigidly mounted at ends adjacent said girder assembly on each of said steps and pivotably connected at opposite ends to said parallel hand rails; a pivot means mounted on a first upper floor in said building and connected to said top of said girder assembly and on the rails or posts allowing pivoting of said moveable stair apparatus to a raised or lowered position relative to a lower floor and to a second upper floor of said building to provide a walkway to the second upper floor or stairway to the lower floor; a pair of cables mounted on each side adjacent to said bottom of said girder assembly for moving said moveable stair apparatus to said raised or lowered position; power means connected to said cables for lengthening or shortening said cables and mounted on said building or stair apparatus to move said moveable stair apparatus to and from said lowered position to said raised position; and lock means between the girder assembly and upper floor for securing said walkway to said upper floor in said raised position.

BRIEF DESCRIPTION OF THE DRAWINGS

The aforementioned affects and advantages of the invention will be appreciated from the following description and accompanying drawings wherein.

SPECIFIC DESCRIPTION

Figure 1:
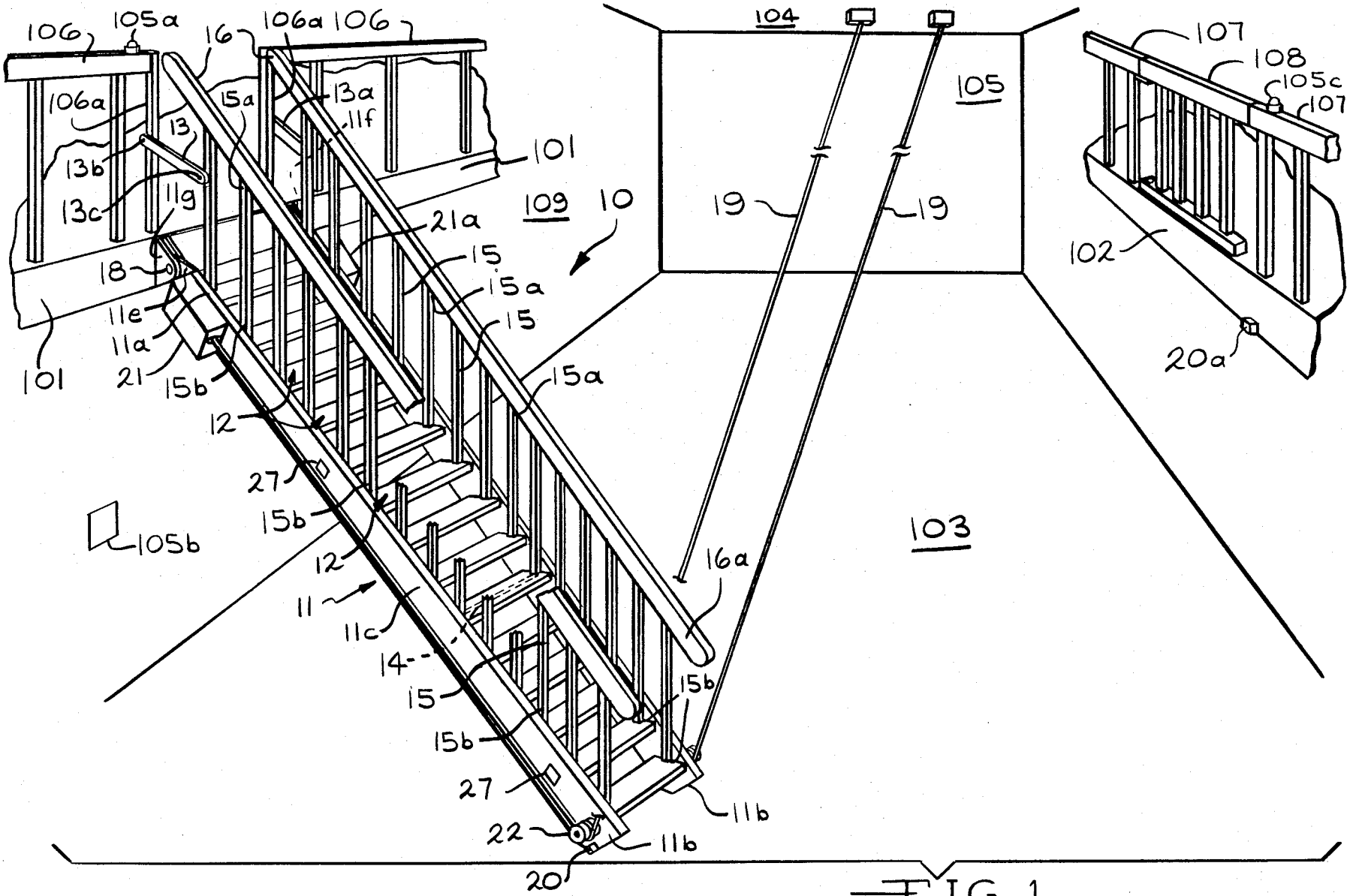
FIG. 1 is a perspective view of the moveable stair apparatus 10 of the present invention which illustrates moveable steps 12 mounted on a girder assembly 11 and more particularly illustrating vertically extending posts 15 mounted on the steps 12 and also including spaced apart parallel hand rails 16 and 16*a* attached to the posts 15.
Figure 2:
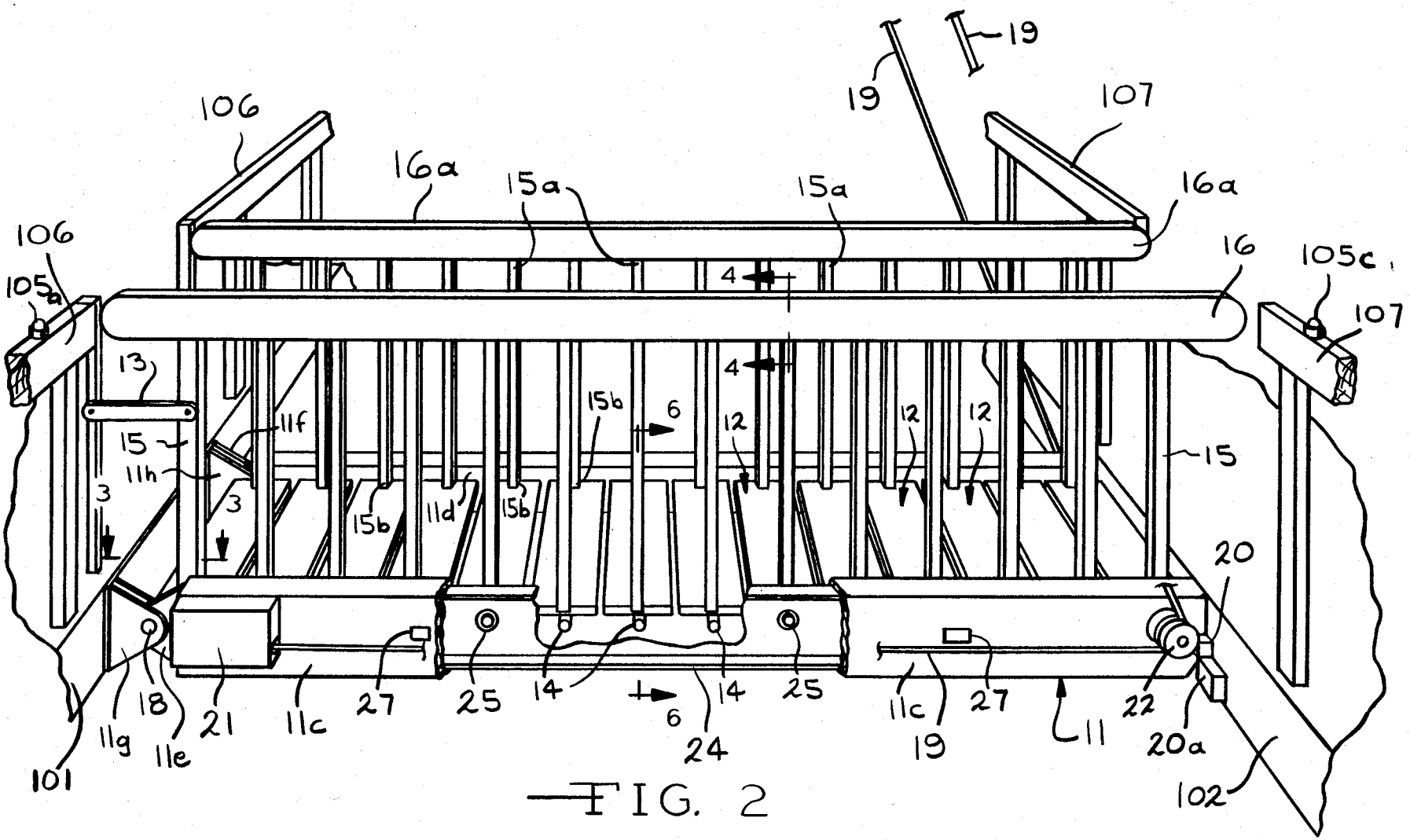
FIG. 2 is a perspective view of the moveable stair apparatus 10 of the present invention as a walkway secured to a second upper floor 102 in the horizontal position by a mechanical latch 20 and stop pin 20*a*.
Figure 5:
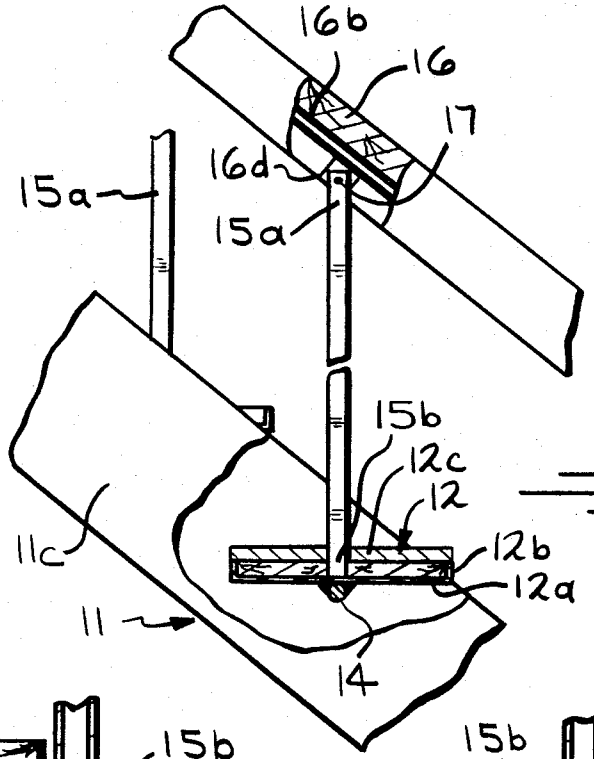
FIG. 5 is a partial cross-sectional side view which illustrates the construction of one step 12 including a support plate 12*a* mounted on a journaled rod 14 and also including a suitable covering 12*c*.
Figure 4:
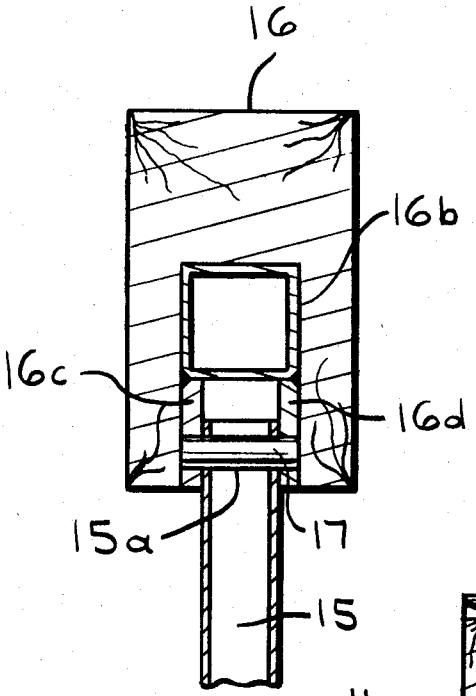
FIG. 4 is a right side partial cross-sectional sectional view along line 4—4 of FIG. 2 which illustrates the vertically extending post 15 pivotably mounted on the hand rail 16 by a second pivot pin 17 which is inserted through extensions 16*c* and 16*d* from tube 16*b*.

FIGS. 1 to 5 show the details of the moveable stair apparatus 10. The moveable stair apparatus 10 includes a girder assembly 11 having a top and bottom ends 11*a* and 11*b* and opposed sides 11*c* and 11*d*. The top end 11*a* of the girder assembly 11 also includes a pair of ears 11*e* and 11*f* for holding a pivot pin 18 discussed hereinafter. A plurality of equally spaced apart steps 12 are journaled between the opposed sides 11*c* and 11*d* of the assembly 11 by a plurality of rods 14 positioned along the horizontal longitudinal axis of the steps 12. The rods 14 as shown in FIG. 2 allow the steps 12 to pivot with pivoting of the girder assembly 11. A plurality of vertically extending posts 15 having upper ends and lower ends 15*a* and 15*b* are provided with the lower ends 15*b* of the posts 15 rigidly mounted at opposite ends on each of the steps 12. The upper end 15*a* of the posts 15 are mounted on a pair of spaced apart parallel hand rails 16 and 16*a* on either side of the steps 12 by a pivot pin 17 (FIGS. 4 and 5). The rails 16 and 16*a* are secured by pivot straps 13 and 13*a* to a rail 106 upright 106*a* by pivot pins 13*b* and 13*c*. A second set of ears 11*g* and 11*h* are mounted on a first loft or floor 101 with the pivot pin 18 secured through the ears 11*e*, 11*f*, 11*g* and 11*h* at the top of the girder assembly 11. The pivot pin 18 allows pivotable movement of the moveable stair apparatus 10 to a raised or a lowered position.

The moveable stair apparatus 10 has a pair of cables 19 attached to the ceiling 104 and around pulleys 22 (one shown) adjacent the bottom 11*b* of the assembly 11 on the outside of sides 11*c* and 11*d* for moving the moveable stair apparatus 10 to a raised and lowered position. Drum winches 21 and 21*a*are mounted on the opposed sides 11*c* and 11*d* of the assembly 11 for lengthening or shortening the cables 19 and thus raise and lower the moveable stair apparatus 10.

A mechanical latch 20 for securing the assembly 11 to a second floor or upper deck 102 is provided. A stop 20*a* for the latch 20 is mounted on the upper deck 102 opposite the loft 101. The mechanical latch 20 and stop 20*a* secure the moveable stair apparatus 10 while in the raised horizontal position as shown in FIG. 2.

Figure 3:
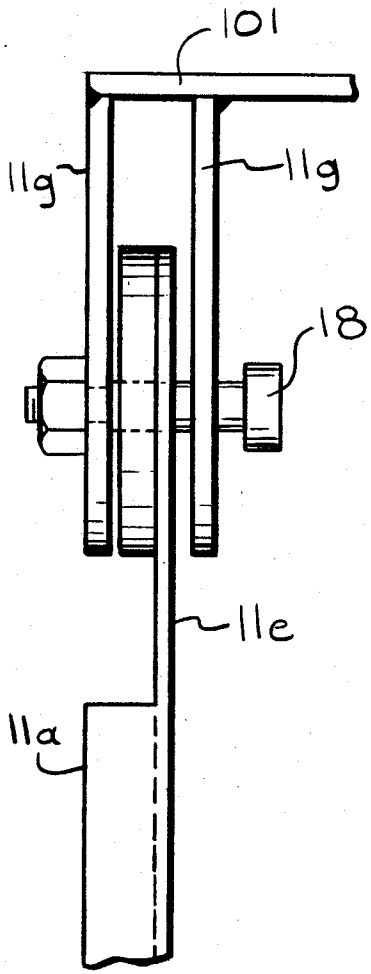
FIG. 3 is a plan partial sectional view along line 3—3 of FIG. 2 particularly illustrating ears 11*g* mounted on a wall 101 and also illustrating a pin 18 which is secured through ear 11*e* of the girder assembly 11 and ears 11*g*.

FIG. 3 shows the details of the pivot pin 18 mounted through ears 11*g* secured to loft 101. The pivot pin 18 is secured through the ear 11*e* at the top 11*a* of the girder assembly 11 allowing downward and upward movement of the girder assembly 11.

FIGS. 4 and 5 show the details of the top 15*a* of the vertically extending post is which is pivotably mounted on the hand rail 16 by the pivot pin 17. The pin 17 is secured through a pair of metal extensions 16*c* and 16*d* from a metal tubular rod 16*b* which are mounted over the top 15*a* of the post 15. The pivot pin 17 allows the hand rails to pivot simultaneously with the steps 12 upon movement of the girder assembly 11.

FIG. 5 shows the details of the construction of the steps 12 which include a metal support plate 12*a* secured to the rod 14 with a wooden (or other material) step plate 12*b* secured thereto. A suitable carpet covering 12*c* can optionally be included.

Figure 6:
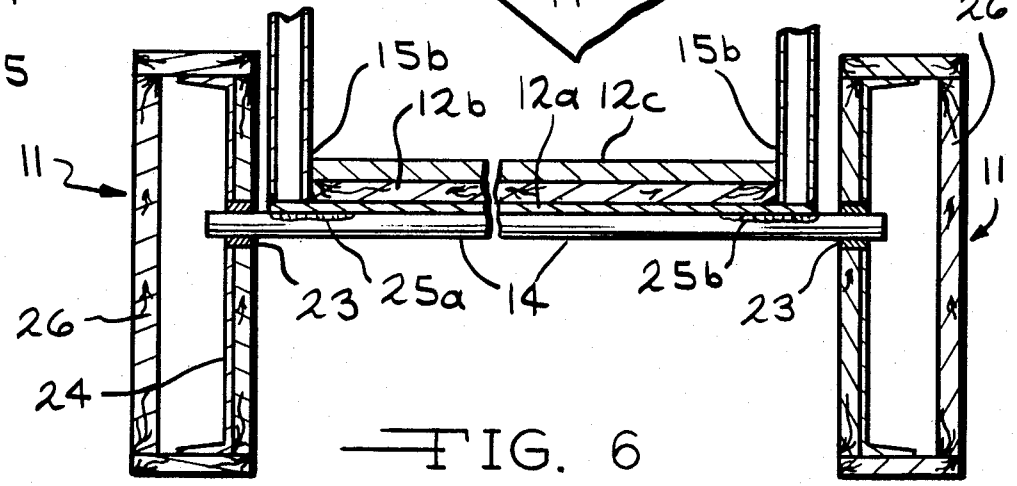
FIG. 6 is a left side cross-sectional view along line 6—6 of FIG. 2 which illustrates the journaled rod 14 positioned along the horizontal longitudinal axis of step 12 and mounted on a steel girder 24 by a bearing 23 in girder assembly 11 and more particularly illustrating a wood cover 26 on the girder assembly 11.

FIG. 6 shows the lower portion 15*b* of the vertically extending post 15 rigidly mounted on the step 12 with the rod 14 positioned along the horizontal axis of step 12 and mounted through bearings 23 at each side 11*c* and 11*d* of a steel girder 24 inside the girder assembly 11. The step plate 12*a* of the step 12 is secured to the rod 14 as illustrated by the welds 25*a* and 25*b* or other suitable attachment means. The girder assembly 11 includes a wood cover 26 over the girder 24. The wood cover 26 extends from the top 11*a* to the bottom 11*b* and along the sides 11*c* and 11*e* of the girder assembly 11.

The moveable stair apparatus 10 allows access from or to a lower floor 103 from or to the upper deck or floor 101 in an A-frame or similar type building structure. The stair apparatus 10 also allows access to and from upper floor 101 to or from a second floor 102. The apparatus 10 functions by pivoting the stairs 12 to form a catwalk or walkway allowing access from the floor 101 out to the second floor 102 of the building structure or by pivoting the stairs 12 between floors 103 and 102 respectively. The mechanical latch 20 and stop 20*a* prevents a sudden downward movement of the apparatus 10 should a cable 19 break while the apparatus 10 is in the catwalk position. The cables 19 include a conventional slack cable switch (not shown) which shuts down all movement should one of the two cables 19 break. It is not intended that a person to ride on while it is in motion for safety reasons.

The moveable stairs 10 are powered by the motor drive winches 21 and 21*a*. The winches 21 and 21*a* can be operated from any one of several push button stations 105*a*, 105*b*, 105*c*. The mechanical latch 20 is released prior to allowing the apparatus 10 to go down to provide the stairs to lower floor 103. Flashing yellow warning lights 27 preferably are attached to the girder assembly 11 to indicate that the stair apparatus 10 is in an unlocked and intermediate position. Safety gate 108 is provided for the guard rail 107. Rail 107 supports station 105*c*. Guard rail 106 supports station 105*a* and wall 109 supports station 105*b*.

It will be appreciated that other means for moving the stairs could be used such as counterweights (not shown) to the stairway apparatus hidden by a wall and connected to the stairway apparatus. A hoist on the ceiling (not shown) could also be used. Numerous variations will occur to those skilled in the art.

It is intended that the foregoing description be only illustrative of the present invention and that the present invention be limited only by the hereinafter appended claims.

We claim:

1. A moveable stair apparatus for use inside a building which comprises:

(a) a pair of spaced apart girder assemblies having a top and bottom and parallel opposed sides;

(b) a plurality of equally spaced apart horizontally oriented steps which are pivotably positioned on a horizontal longitudinal axis between the opposed sides of the girder assembly;

(c) a plurality of rods mounted in a horizontal plane along the axis beneath the steps and journalled between the the opposed sides of the girder assembly and rigidly mounted to the steps so that the steps are pivotable;

(d) a pair of spaced apart parallel hand rails mounted above the girder assembly and steps including a plurality of vertically extending posts rigidly mounted at ends adjacent the girder assembly on each of the steps and pivotably connected at opposite ends to the parallel hand rails;

(e) a pivot means mounted on a first upper floor in the building and connected to the top of the girder assembly and on the rails or posts allowing pivoting of the moveable stair apparatus to a raised or lowered position relative to a lower floor and to a second upper floor of the building to provide a walkway to the second upper floor or stairway to the lower floor;

(f) a pair of cables mounted on each side adjacent to the bottom of the girder assembly for moving the moveable stair apparatus to the raised or lowered position;

(g) power means connected to the cables for lengthening or shortening the cables and mounted on the building or stair apparatus to move the moveable stair apparatus to and from the lowered position to the raised position, wherein the power means is actuated by operating stations located in easily accessible positions on each of the lower floor and the upper floors of the inside of the building; and (h) lock means between the girder assembly and upper floor for securing the walkway to the upper floor in the raised position.

2. The moveable stair apparatus in accordance with claim 1 wherein the pivot means for the girder assembly is a pin secured through apertures in ears mounted on the top of the opposed sides of the girder assembly and on the first upper floor.

3. The moveable stair apparatus in accordance with claim 1 wherein the pair of cables are powered by at least one winch mounted on the girder assembly.

4. The moveable stair apparatus in accordance with claim 3 wherein the winch has a brake which prevents the cables from being rapidly released.

5. The moveable stair apparatus in accordance with claim 1 wherein the pair of cables include a slack cable switch to shut down movement of the apparatus if a single cable breaks.

6. The moveable stair apparatus in accordance with claim 1 wherein the bottom of the girder assembly includes a mechanical latch as the lock means which engages a stop on the second upper floor for securing the moveable stairs while in the raised position.

7. The moveable stair apparatus in accordance with claim 1 wherein the girder assembly supports a flashing yellow warning light indicating that the stairs are not in the raised portion and locked by the lock means or the lowered position.

8. The moveable stair apparatus in accordance with claim 1 wherein the raised position provides the walkway from the first upper floor to the second upper floor which is inside the building.

9. The moveable stair apparatus in accordance with claim 1 wherein the raised position provides the walkway from the first upper floor inside the building to an outside deck as the second upper floor in the building.

10. The moveable stair apparatus in accordance with claim 1 wherein the power means is an electrically powered winch and is operated by push buttons at the operating stations which provide electricity to or shut-off electricity to the winch.

* * * * *